United States Patent [19]

Hawke

[11] Patent Number: 4,706,542

[45] Date of Patent: Nov. 17, 1987

[54] LOW VOLTAGE ARC FORMATION IN RAILGUNS

[75] Inventor: Ronald S. Hawke, Livermore, Calif.

[73] Assignee: The United States of America as represented by the United States Department of Energy, Washington, D.C.

[21] Appl. No.: 762,649

[22] Filed: Aug. 5, 1985

[51] Int. Cl.[4] ..... F41F 1/02

[52] U.S. Cl. ..... 89/8; 124/3; 310/12

[58] Field of Search ..... 89/8; 124/3; 310/12–14; 318/135; 307/106–108

[56] References Cited

U.S. PATENT DOCUMENTS 4,433,608 2/1984 Deis et al. ..... 89/8

4,437,383 3/1984 Deis et al. ..... 89/8

OTHER PUBLICATIONS

R. S. Hawke et al., "Magnetic Propulsion Railguns: Their Design and Capabilities", Megagauss Physics and Tech. 1983, p. 297.

R. S. Hawke, "Devices for Launching 0.1 g Projectiles to 150 Km/s or More to Initiate Fusion, Part 2, Railgun Accelerators", Lawrence Livermore National Laboratory Report No. UCRL-52778 7/6/79.

*Primary Examiner*—Deborah L. Kyle

*Assistant Examiner*—John E. Griffiths

*Attorney, Agent, or Firm*—Henry P. Sartorio; Clifton E. Clouse, Jr.; Judson R. Hightower

[57] ABSTRACT

A low voltage plasma arc is first established across the rails behind the projectile by switching a low voltage high current source across the rails to establish a plasma arc by vaporizing a fuse mounted on the back of the projectile, maintaining the voltage across the rails below the railgun breakdown voltage to prevent arc formation ahead of the projectile. After the plasma arc has been formed behind the projectile a discriminator switches the full energy bank across the rails to accelerate the projectile. A gas gun injector may be utilized to inject a projectile into the breech of a railgun. The invention permits the use of a gas gun or gun powder injector and an evacuated barrel without the risk of spurious arc formation in front of the projectile.

20 Claims, 2 Drawing Figures

LOW VOLTAGE ARC FORMATION IN RAILGUNS

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention relates generally to electromagnetic railgun accelerators and more particularly to the formation of an electrically conducting plasma arc which can be used as an armature to accelerate a projectile in a railgun.

Railgun accelerators have potential to accelerate projectiles to very high velocities in very short distances. Recent research has demonstrated the usefulness of railguns for research and industrial applications. The railgun accelerator is essentially a DC motor consisting of a pair of rigid parallel conductors that carry current to and from an interconnecting movable conductor. The connecting link functions as an armature and the parallel rails serve as a single turn field winding. The resulting Lorentz force on the armature is proportional to the square of the current. Railguns will enable research and applications at previously unattainable velocities, in excess of 10 km/s. Potential applications include (1) equation of state research of matter at high pressure and high energy density, (2) orbital launching from the earth's, moon's and other planetary surfaces, and (3) fusion energy production, either to inject fuel pellets into a magnetic fusion reactor or to ignite fuel pellets with the impact of small projectiles.

It is not necessary that the armature be a soid metal conductor. An arc discharge initiated across the base of a dielectric projectile can also act as an armature if it is confined behind the projectile. The confinement can be provided by the conducting rails on two sides and dielectric rail spacers on the other two sides. The plasma arc armature is in fact preferable to a solid metallic conductor since it removes the limitations resulting from sliding contacts and permits higher velocities. The plasma easily maintains contact with the rails. A variety of power sources have been utilized to provide the high current and long pulse durations needed to accelerate projectiles to hypervelocities including batteries, capacitor banks, homopolar generators and magnetic flux compression generators.

In a typical prior art railgun system, as shown in FIG. 1, a projectile is injected into the railgun by a gas gun and a capacitor bank $C_o$ generates a current through the railgun circuit via a fuse mounted on the back of the projectile. The overloaded fuse rapidly vaporizes, however, and establishes the initial plasma arc. The arc and the projectile accelerate along the rails of the railgun. To avoid excessive launcher damage the projectile is sometimes injected into the breech of the railgun with a helium gas gun. By pre-accelerating the projectile to about 1 km/s with a gas injector the dwell time of the arc on the rails and dielectric is reduced. By reducing the dwell time of the arc at the projectile starting position, rail and dielectric erosion are greatly reduced.

Railgun operation for equation of state, space and other applications requires evacuation of the launcher so that the projectile is the first significant pressure generator at the target. An initial launcher pressure of about 0.001 atmosphere (0.76 torr) or less is often needed. The utilization of an evacuated launcher can result in formation of a spurious arc in the region in front of the projectile. The use of a gas gun injector can further aggravate this problem. If the full accelerating high voltage is applied to the rails to produce the plasma arc, residual vapor pressure in the railgun and gas leakage past the projectile can produce a gas pressure reducing the breakdown voltage in front of the projectile. Arc breakdown in front of the projectile results in loss of performance, interference with the experiment and produces more severe erosion of the launcher. It is difficult, but possible, to prevent gas leakage past the projectile until a low voltage plasma arc is fully formed behind the projectile. It is often not possible to eliminate all residual gas from the barrel bore, hence the chances of having a zone of gas preceed the projectile is high. In a launcher initially evacuated to the low pressure side of Paschen's breakdown relation, the preceeding gas will tend to cause breakdown at the minimum voltage, typically lower than the power supply voltage.

Accordingly, it is an object of the invention to provide a method of railgun arc formation without high rail voltage.

It is also an object of the invention to provide railgun arc formation in a high vacuum launcher in which the projectile is injected by means of a gas gun.

It is a further object of the invention to provide a method for railgun arc formation which greatly reduces rail and dielectric erosion.

SUMMARY OF THE INVENTION

An arc forming capacitor is charged to a low voltage, typically about 150 volts, and connected through a normally open switch to the rails of the railgun. Although it is not required by the invention a pre-accelerator can be used. In this case a projectile having a conducting fuse on the backside is injected into the railgun breech by a gas gun. When the fuse on the back of the projectile arrives at the breech of the railgun the fuse completes the circuit across the railgun. A voltage sensor connected across the rails of the railgun detects a change in voltage and sends a trigger to the normally open switch, so that the arc forming capacitor is discharged. Current flows through the fuse and establishes a plasma arc behind the projectile. The voltage across and/or current through the fuse are detected by a discriminator circuit which determines when a proper plasma arc has been formed. The discriminator circuit may also be gated with a timing signal from the gas gun. The discriminator circuit triggers a normally open switch completing the high energy (high voltage) power circuit connected through the railgun. Since the high voltage is applied only after a low voltage plasma arc is fully formed behind the projectile, the voltage across the rails when the high voltage capacitor bank is connected across the rails will be limited to the established arc voltage. Once the plasma arc is stably formed the voltage across the rails in front of the arc is limited to the voltage of the plasma arc itself which is lower than the minimum breakdown voltage so that the chance of arc formation in front of the projectile is minimized.

IN THE DRAWINGS

DETAILED DESCRIPTION OF THE PREFERRED EMBODIMENT

Figure 1:
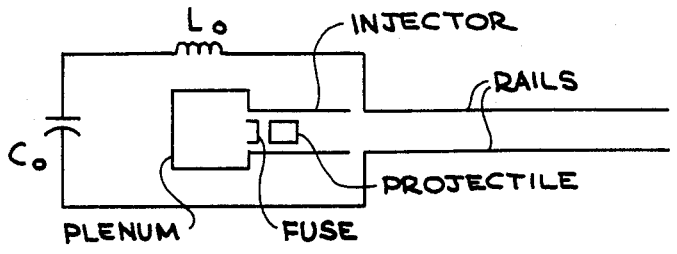
FIG. 1 (PRIOR ART)
FIG. 1 is a schematic of a prior art railgun system.
Figure 2:
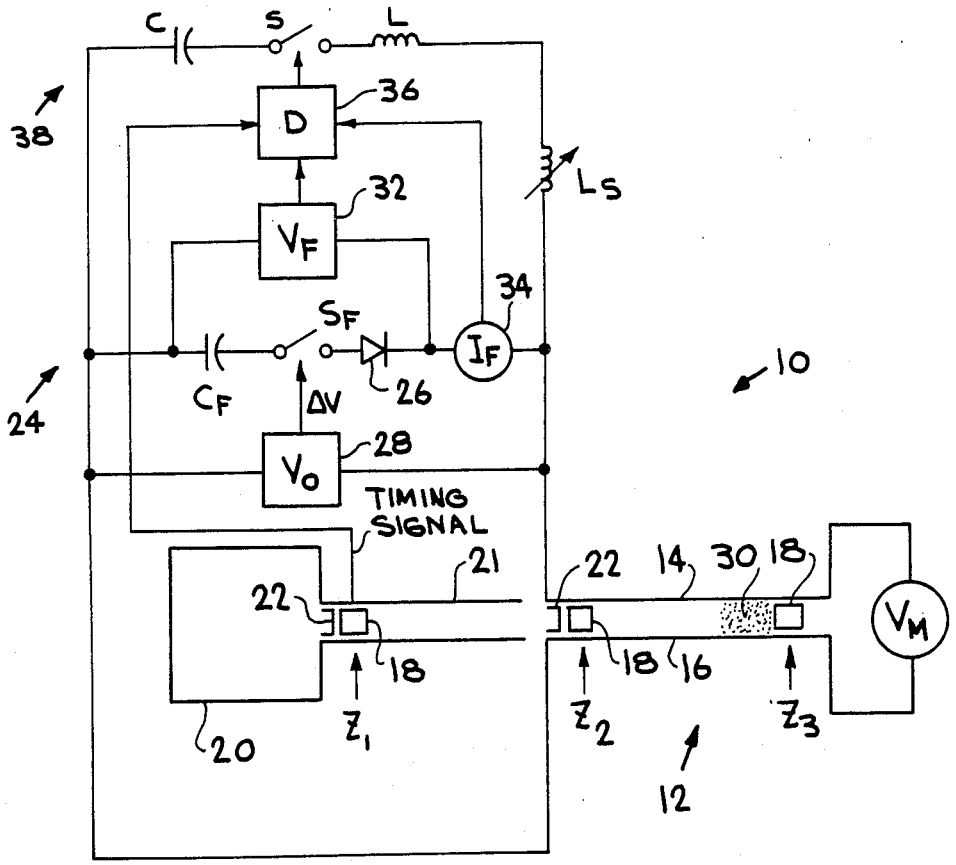
FIG. 2 is a schematic of a railgun according to the invention in which a low voltage plasma arc is formed before the high energy, high current and high voltage power source is applied to the railgun.

Railgun system 10, as shown in FIG. 2, comprises a railgun 12 having a pair of parallel conducting rails 14 and 16 through which a projectile 18 is accelerated. A gas gun injector 20 is utilized to initially accelerate projectile 18 so that it is introduced into the railgun with an initial velocity. A fuse 22 is mounted on the backside of projectile 18. the projectile 18 starts at the breech position ($Z_1$) in the injector barrel 21 of gas gun injector 20. The injector barrel 21 is aligned with and insulated from rails 14, 16 of railgun 12. Projectile 18 is accelerated by gas gun injector 20 and introduced into the breech (position $Z_2$) of railgun 12.

Low voltage plasma arc formation circuit 24 is connected across the rails 14, 16 of the railgun. Arc formation circuit 24 comprises a low voltage capacitor $C_F$, normally open switch $S_F$ connected in series with $C_F$ and diode 26 following switch $S_F$. Arc forming capacitor $C_F$ is typically about 50 mf and initially charged to about 150 volts. Arc formation circuit 24 is connected across the breech of railgun 12. A voltage detector or sensor 28 is also connected across the breech of railgun 12 in parallel with arc formation circuit 24. When projectile 18 is injected by means of gas gun injector 20 into the breech of railgun 12, fuse 22 forms a conducting path between rails 14 and 16. Voltage sensor 28 detects a drop in voltage at the breech of railgun 12 caused by the injection of projectile 18 with fuse 22 and sends a triggering signal to switch $S_F$. As an example, voltage sensor 28 can be implemented by a small capacitor, e.g., 0.1 $\mu$f, charged to about 150 V, connected across the rails so that the fuse shorts the capacitor to provide a trigger signal. Switch $S_F$ is typically an SCR. The SCR prevents charging of $C_F$ by subsequent oscillations of the high current circuit. Diode 26 is optional for additional protection. When switch $S_F$ is closed, capacitor $C_F$ is discharged causing current to flow through fuse 22 in order to vaporize the fuse 22 to establish a plasma arc across rails 14, 16 behind projectile 18. Since the projectile 18 is injected into railgun 12 with an initial velocity, dwell time in the breech while arc formation occurs is minimized thereby reducing erosion of the rails.

Projectile 18 continues to move through the rail gun while capacitor $C_F$ is discharged and current flow through conducting fuse 22 increases and vaporizes the fuse to form a plasma arc 30 behind projectile 18. Voltage $V_F$ across and current $I_F$ through fuse 22 are measured by means of voltage sensor 32 and current sensor 34, respectively. Output signals from voltage sensor 32 and current sensor 34 are input into a discriminator 36 which determines when a proper plasma arc 30 has been formed. Discriminator 36 is set at certain preselected values of plasma arc voltage and/or current. Only one of the two inputs may be required, i.e., only the voltage or current. When discriminator 36 determines that a proper plasma arc 30 has been formed across rails 14, 16 behind projectile 18 a trigger signal is applied to switch S to close the switch and discharge capacitor C through inductor L and saturable reactor $L_S$ across rails 14, 16. Discriminator 36 may also be gated by means of a timing signal from gas gun 20 that indicates that a projectile has actually been launched. Projectile acceleration circuit 38 is connected in parallel with arc formation circuit 24 across rails 14, 16 of railgun 12. Acceleration circuit 38 comprises, in series, capacitor C followed by switch S, followed by current limiting inductor L, followed by optional saturable reactor $L_S$ which may be used for limiting voltage spikes. Capacitor C is typically about 50 mf and charged to the full accelerating voltage, e.g., 5 kV; alternatively other current sources may be used in place of capacitor C. Switch S is typically a high current ignitron.

Thus the full accelerating voltage is switched across the rails only after arc 30 is fully established behind projectile 18 (position $Z_3$). Accordingly the full voltage is not applied prior to or during the period in which arc 30 is being formed so that breakdown across the rails in front of the projectile is minimized. Also, once plasma arc 30 has been formed the voltage across rails 14, 16 in front of the arc is that of the plasma arc itself. Thus the maximum voltage across the rails is limited to about 150 volts which is less than the minimum breakdown voltage of about 190 volts. These voltages are applied to a particular design and may be different in other designs. In general, the minimum breakdown voltage may vary for each railgun design. According to the invention, the arc forming circuit is operated at some voltage below the minimum breakdown voltage, e.g., $\frac{3}{4}$ of breakdown voltage.

In a preferred embodiment of a railgun in which the invention may be implemented, a single stage, 1 meter long, 35 MPa (5000 psi) helium gas gun injector is utilized to accelerate a projectile up to 1.5 km/s before injection into the breech of a railgun. This injector is described in "Rail Accelerator Development for Ultra-High Pressure Research", by R. S. Hawke et al., *IEEE Transactions on Magnetic*, Vol. MAG-20, No. 2, March 1984, pgs. 291–193, which is herein incorporated by reference. A pair of copper rails are separated by dielectric rail spacers made of an insulating material. Polycarbonate or more rigid insulators such as alumina ceramic may be used for the spacers. Launcher lengths of 1.65 m and 5.2 m have been produced. A 50 mf capacitor bank charged to 5 kV is used as the accelerating current source. For pulse shaping the current flows through an adjustable inductor whose inductance can be selected in the range of 0.5–5.3 $\mu$H and whose total resistance is about 670 $\mu\Omega$. The inductor can operate at current over 600 kA and the launcher at over 300 kA.

Changes and modifications in the specifically described embodiments can be carried out without departing from the scope of the invention which is intended to be limited only by the scope of the appended claims.

I claim:

1. A method of accelerating a projectile along a pair of conducting rails in a railgun, comprising:

producing a plasma arc across the rails behind the projectile at a voltage substantially below an accelerating voltage;

applying an accelerating voltage to the rails after the plasma arc has been formed to accelerate the projectile.

2. The method of claim 1 wherein the step of producing a plasma arc is performed by discharging an arc forming capacitor across the rails behind a projectile.

3. The method of claim 1 further comprising injecting a projectile between the rails with an initial velocity.

4. The method of claim 3 further comprising detecting the presence of the injected projectile between the rails by detecting a voltage drop across the rails.

5. The method of claim 1 further comprising detecting the formation of a plasma arc.

6. The method of claim 5 wherein the step of detecting the formation of the plasma arc is performed by measuring both the current through and voltage across the arc, and the step of applying the accelerating voltage to the rails is performed by switching the accelerating voltage across the rails when said arc current and voltage reach preselected values.

7. The method of claim 5 wherein the step of detecting the formation of the plasma arc is performed by measuring the current through the arc, and the step of applying the accelerating voltage to the rails is performed by switching the accelerating voltage across the rails when the arc current reaches a preselected value.

8. The method of claim 5 wherein the step of detecting the formation of the plasma arc is performed by measuring the voltage across the arc, and the step of applying the accelerating voltage to the rails is performed by switching the accelerating voltage across the rails when the arc voltage reaches a preselected value.

9. A railgun apparatus, comprising:

a pair of spaced parallel conducting rails for guiding a projectile;

an arc formation circuit comprising an arc forming capacitor connected through a normally open arc formation circuit switch across the rails and charged to a voltage less than a minimum voltage which causes spurious arcing across the rails ahead of the projectile to form a plasma arc behind a projectile positioned between the rails prior to application of an accelerating current;

arc formation detector means operatively connected to the arc formation circuit for detecting the formation of a plasma arc between the rails;

an acceleration circuit operatively connected to the rails in parallel with the arc formation circuit for accelerating the arc formed by the arc formation circuit, including:

accelerating voltage supply means electrically connected to the rails for applying an accelerating current to the rails;

acceleration circuit switching means between the accelerating voltage supply means and the rails and connected to the arc formation detector means for switching the accelerating current onto the rails after the formation of a plasma arc behind a projectile by the arc formation circuit.

10. The apparatus of claim 9 further including a diode positioned after the arc formation circuit switch to prevent reverse charging of the arc forming capacitor.

11. The apparatus of claim 9 further including injection means for injecting a projectile between the rails with an initial velocity.

12. The apparatus of claim 11 wherein the injection means is a gas gun.

13. The apparatus of claim 1 further comprising voltage detecting switch closing means connected across the rails which detects a voltage drop across the rails produced when a projectile is injected between the rails and sends a trigger signal to close the arc formation circuit switch.

14. The apparatus of claim 13 wherein the arc formation circuit switch is a silicon controlled rectifier.

15. The apparatus of claim 9 wherein the acceleration circuit switching means comprises a normally open acceleration circuit switch connected in series between the accelerating voltage supply means and the rails, and the arc formation detector means includes trigger means for closing the acceleration circuit switch only after the formation of the plasma arc.

16. The apparatus of claim 15 wherein the arc formation detector means comprises arc formation sensor means selected from the group consisting of at least one of a voltage detector electrically connected to the rails for detecting the voltage across the plasma arc and a current detector operatively connected to the rails for detecting the current through the plasma arc, and a discriminator connected to the arc formation sensor means for providing a signal to close the acceleration circuit switch when preselected values of said at least one of plasma arc voltage and current have been reached.

17. A railgun apparatus, comprising:

a pair of spaced parallel conducting rails for guiding a projectile;

an arc forming capacitor connected across the rails;

a first switch connected in series between the capacitor and the rails;

first switch closing means operatively connected to the rails and the first switch for detecting when a projectile is injected between the rails and then closing the first switch to discharge the capacitor across the rails to form a plasma arc behind the projectile;

accelerating voltage supply means electrically connected across the rails;

a second switch connected in series between the supply means and the rails;

a second switch connected in series between the supply means and the rails;

second switch closing means operatively connected to the rails and the second switch for detecting when a plasma arc has been formed between the rails and then closing the second switch to apply an accelerating voltage to the rails.

18. The apparatus of claim 17 further including a gas gun injector for injecting a projectile between the rails.

19. The apparatus of claims 17 wherein the region between the rails is evacuated.

20. The apparatus of claim 17 wherein the second switch closing means comprises arc formation sensor means selected from the group consisting of at least one of a voltage detector for measuring plasma arc voltage and a current detector for measuring plasma arc current, and a discriminator connected to the arc formation sensor means for providing a signal to close the second switch when preselected values of said at least one of plasma arc voltage and current have been reached.

* * * * *